United States Patent [19]

Rivelli

[11] 3,940,114

[45] Feb. 24, 1976

[54] FENCING KIT

[76] Inventor: Joseph A. Rivelli, 5047 Oakton St., Skokie, Ill. 60076

[22] Filed: July 16, 1974

[21] Appl. No.: 488,934

Related U.S. Application Data

[63] Continuation of Ser. No. 353,306, April 23, 1973, abandoned.

[52] U.S. Cl. ..... 256/32; 256/25

[51] Int. Cl.[2] ..... E04H 17/14

[58] Field of Search ..... 256/24, 25, 26, 32, 35, 256/37, 47, 48

[56] References Cited

UNITED STATES PATENTS

| | | | |
|---|---|---|---|
| 299,086 | 5/1884 | Over | 173/90 |
| 1,284,569 | 11/1918 | Bikowski | 256/24 X |
| 2,052,774 | 9/1936 | Kundert | 256/47 |
| 2,147,828 | 2/1939 | Daniels | 173/90 X |
| 3,025,955 | 3/1962 | Caldwell et al. | 256/24 UX |
| 3,140,858 | 7/1964 | Westphal | 256/24 |
| 3,143,817 | 8/1964 | Paulson | 173/90 X |
| 3,203,396 | 8/1965 | Carmichael | 256/24 X |
| 3,216,432 | 11/1965 | Eddy | 256/24 |
| 3,345,040 | 10/1967 | Revelli | 256/37 |

*Primary Examiner*—Dennis L. Taylor

[57] ABSTRACT

A kit for fencing a small area comprises a predetermined length of flexible fencing material having a total length which is less than the perimeter of the area by a small amount as measured by the permissive stretch of the fencing. A plurality of fence posts are secured to the fencing with distances therebetween of a predetermined amount and a plurality of ground engaging members are adapted to enter the ground to have the posts secured thereto, each of the ground engaging members being spaced from each other by a modular distance which is greater than the distance between the posts secured to the fencing. A closing post is provided with structure for driving the ground engaging members into the ground seriatim, and it is located after placing the ground engaging members.

4 Claims, 7 Drawing Figures

FIG.3
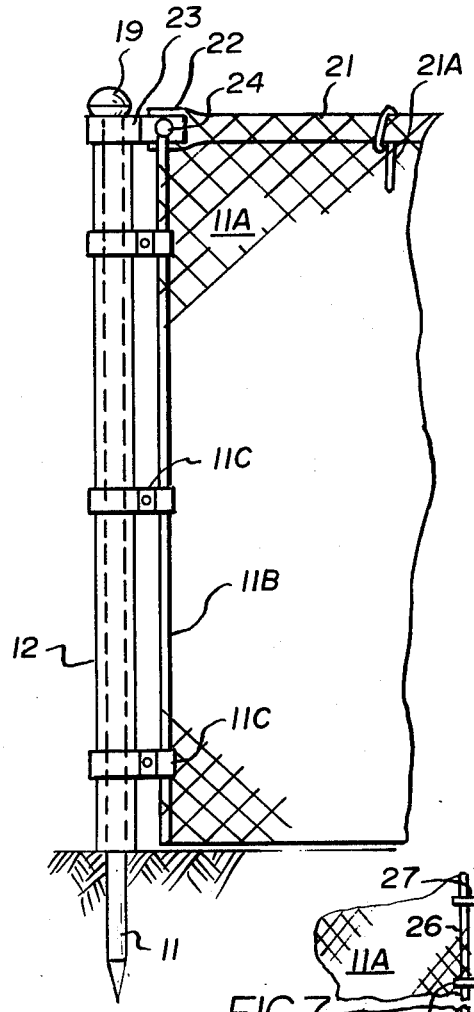
FIG.4
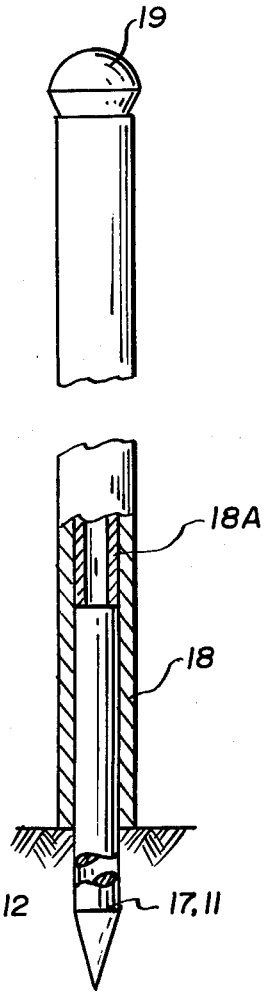
FIG.5
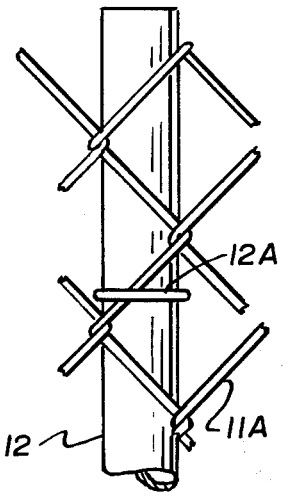
FIG.6
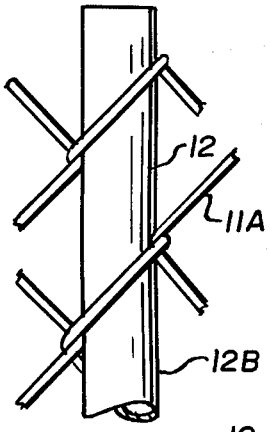
FIG.7
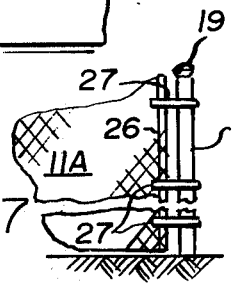
FIG.1
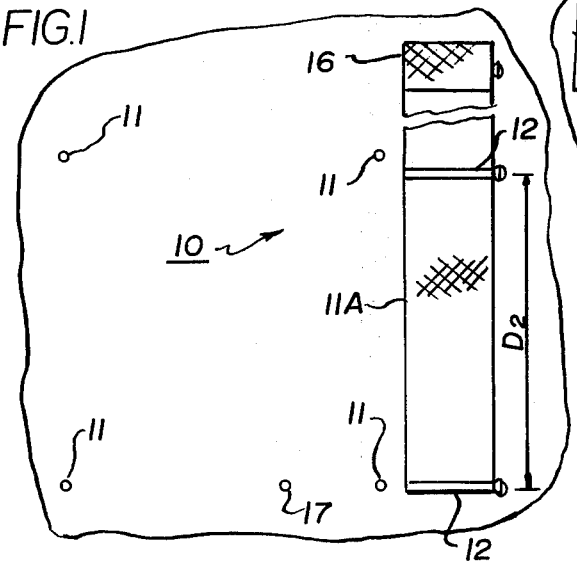
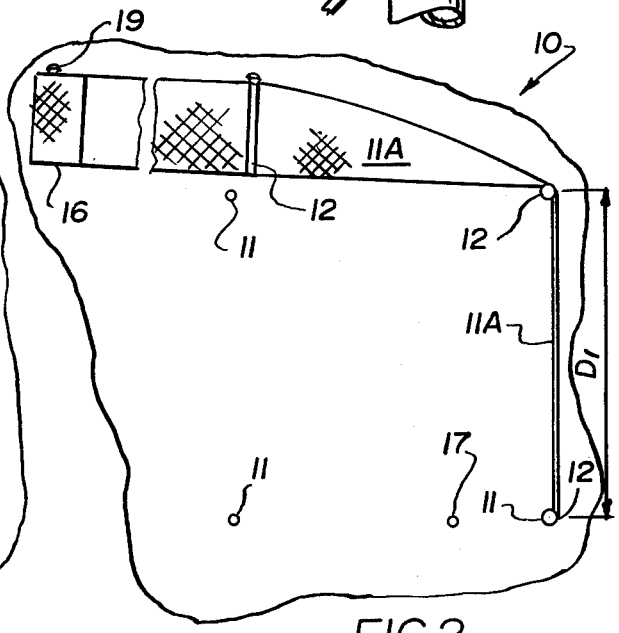
FIG.2

FENCING KIT

This application is a continuation of Ser. No. 353,306 filed Apr. 23, 1973, now abandoned

BACKGROUND OF THE INVENTION

1. Field of the Invention

The structure disclosed herein makes it possible to enclose a small play area, for example, and to readily change the location thereof as desired.

2. The Prior Art

Fencing of the type as disclosed, but not arranged as disclosed, is disclosed in Rivelli U.S. Pat. No. 3,345,040 for Chain Link Fencing.

SUMMARY OF THE INVENTION

The structure according to the present invention can be merchandised as a kit and delivered to a site where it can be readily placed into position. The structure disclosed consists of chain link fencing, but there are a number of other forms of flexible fencing as readily adaptable for such purpose.

THE DRAWING

FIG. 1 is a plan view of a fencing kit according to the present invention, showing the same ready to be erected into position;

FIG. 2 is a similar view showing the components of the kit partly erected;

FIG. 3 is a detailed elevational view showing one of the end posts in erected position with the flexible fencing secured thereto;

FIG. 4 is an elevational view of a closing post, parts thereof being shown in longitudinal section;

FIG. 5 is a detailed elevational view showing the manner in which the fencing may be secured to a post;

FIG. 6 is an elevational view showing the posts threaded between the links of chain link fencing; and FIG. 7 is a detailed elevational view showing how the area is closed at a gate portion of the kit.

The kit according to the present invention is referred to generally by the reference numeral 10 and consists of a length of flexible fencing 11A having posts 12 secured thereto in any convenient fashion, as by tie members 12A seen in FIG. 5. The kit 10 is shipped in a roll 16 thereof with the posts 12 secured thereto. A closing post 18 is made of tubular stock as shown and is provided with a central sleeve 18A which is welded in the interior thereof. The closing post 18 is adapted to drive ground engaging members 11 into the ground, the closing post 18 operating in the nature of a drop hammer. Closing post 18 is not secured to roll 16 for obvious reasons.

The spacing between adjacent ground engaging members 11 is at a modular distance $D_1$ which is greater than a second modular distance $D_2$ , corresponding to the distance between adjacent posts 12 secured to the flexible fencing 11A. After the ground engaging members 11 are placed at the proper modular distances $D_1$ apart, flexible fencing 11A can be stretched a slight amount whereby the posts 12 are engaged with the ground engaging members 11. The operation described is continued until it becomes necessary to place the closing post 18 in position, it being the last one so placed, it being adapted to place a final ground engaging member 17, as seen more clearly in FIGS. 2 and 4.

The first closing posts 12 is shown in FIG. 3, and end lacing member 11B is shown at the starting end of the flexible fencing 11A, member 11B being secured to the posts 12 by conventional securing means 11C. Each of the posts 12 is provided with a top closure member 19 and the distance between adjacent posts 12 is spanned by an upper stringer member 21 having slotted end members 22 adapted to engage with an uppermost abutment member 23. Each of the upper members has a plurality of clip members 21A for securing the top edges of the flexible fencing 11A to the stringer member 21.

The last length of flexible fencing 11A between the last placed ground engaging member 17 and the first post 12 is provided with vertical member 26 which can be laced into the flexible fencing material 11A and secured to the first placed post 12 by conventional securing members 27 which are arranged to be detached from the vertical members 26.

Referring now to FIG. 6, there is shown an arrangement whereby the post 12 can be threaded through the link of the fencing material 11A if desired.

I claim:

1. A kit for fencing a small area such as a play area or the like without the need of special tools, said kit comprising:

a. a predetermined length of flexible fencing material having a total length less than the perimeter of said area by a small amount as measured by the permissive stretch of said fencing to enclose said area along said perimeter;

b. a plurality of fence posts including means for securing each post to said flexible fencing with a distance between each post to a predetermined amount;

c. a plurality of ground engaging members, each being separable from said fence posts, each being adapted to enter the ground and thereafter to have a fence post secured thereto;

d. said ground engaging members being spaced from an adjacent one a selected modular distance which is slightly greater than corresponding distance between cooperating posts secured to said flexible fencing;

e. a closing post having a dual function:

i. one being that of driving said ground engaging members into the ground one by one prior to the securement thereto to a related fence post, ii. the other being that of driving the ground engaging member for said closing post prior to the securement to said last named ground engaging member of said closing post;

f. said closing post having an internal diameter corresponding to the diameter of said ground engaging member, and having;

g. a weight affixed therewithin spaced from an end thereof corresponding generally to the extent of said ground engaging member above the ground;

h. said weight being of mass sufficient to enable said closing post to drive said ground engaging members readily into the ground.

2. The kit according to claim 1 wherein said flexible fencing material extends from said closing post to the first so located fence posts.

3. The according to claim 2 wherein said flexible fencing material is provided with structure to secure same detachably to the first placed post.

4. The kit according to claim 1 including structure extending between said posts for maintaining same in proper spaced relationship at the tops thereof.

* * * * *